US009380828B2

(12) United States Patent
Lee

(10) Patent No.: US 9,380,828 B2
(45) Date of Patent: Jul. 5, 2016

(54) STRUCTURE OF ATHLETIC SHOE

(71) Applicant: Po-Yao Lee, Taichung (TW)

(72) Inventor: Po-Yao Lee, Taichung (TW)

( * ) Notice: Subject to any disclaimer, the term of this patent is extended or adjusted under 35 U.S.C. 154(b) by 346 days.

(21) Appl. No.: 14/105,181

(22) Filed: Dec. 13, 2013

(65) Prior Publication Data

US 2015/0164178 A1 Jun. 18, 2015

(51) Int. Cl.

| | |
|---|---|
| ***A43B 13/18*** | (2006.01) |
| ***A43B 7/14*** | (2006.01) |
| ***A43B 17/18*** | (2006.01) |

(52) U.S. Cl.

CPC ..... *A43B 7/144* (2013.01); *A43B 7/145* (2013.01); *A43B 7/148* (2013.01); *A43B 7/1425* (2013.01); *A43B 7/1435* (2013.01); *A43B 7/1445* (2013.01); *A43B 7/1465* (2013.01); *A43B 13/181* (2013.01); *A43B 17/18* (2013.01)

(58) Field of Classification Search

CPC ..... A43B 7/145; A43B 7/1445; A43B 7/144; A43B 7/1465; A43B 7/148; A43B 7/149; A43B 7/1425; A43B 7/1435; A43B 13/18; A43B 13/181; A43B 13/186; A43B 13/40; A43B 17/18

USPC ..... 36/28, 30 R, 31

See application file for complete search history.

(56) References Cited

U.S. PATENT DOCUMENTS

| | | | | | |
|---|---|---|---|---|---|
| 1,841,942 | A * | 1/1932 | Fenton | A43B 7/14 | 36/145 |
| 3,890,725 | A * | 6/1975 | Lea | A43B 3/24 | 36/11.5 |
| 4,779,359 | A * | 10/1988 | Famolare, Jr. | A43B 13/203 | 36/28 |
| 5,720,117 | A * | 2/1998 | Toschi | A43B 23/22 | 36/169 |
| 6,065,229 | A * | 5/2000 | Wahrheit | A43B 13/12 | 36/25 R |
| 7,380,352 | B2 * | 6/2008 | Seiter | A43B 7/1425 | 36/28 |
| 7,426,792 | B2 * | 9/2008 | Swigart | A43B 3/0031 | 36/28 |
| 2007/0151124 | A1 * | 7/2007 | Chan | A43B 7/144 | 36/35 R |
| 2013/0185955 | A1 * | 7/2013 | Cheng | A43B 13/14 | 36/28 |

* cited by examiner

*Primary Examiner* — Ted Kavanaugh
(74) *Attorney, Agent, or Firm* — Leong C. Lei

(57) ABSTRACT

An athletic shoe includes an upper section and a sole section. The upper section is attached to the sole section. The upper section includes at least a wearing opening. The sole section includes a bottom portion, a support portion, and a receiving portion. The support portion is arranged between the bottom portion and the receiving portion and extends from a shoe heel portion of the sole section toward a shoe sole portion of the sole section. The receiving portion includes a first trough, a second trough, and a third trough formed therein. The first trough receives therein a first soft pad that corresponds in shape thereto. The second trough receives therein a second soft pad that corresponds in shape thereto. The third trough receives therein a third soft pad that corresponds in shape thereto. As such, the sole section is provided with a plurality of rush stop sites.

6 Claims, 6 Drawing Sheets

STRUCTURE OF ATHLETIC SHOE

TECHNICAL FIELD OF THE INVENTION

The present invention generally relates to a structure of an athletic shoe, and more particularly to a structure of an athletic shoe that alleviates front rushes of a foot in the athletic shoe so as to improve the safety and comfortableness of the foot wearing the athletic shoe.

DESCRIPTION OF THE PRIOR ART

The progress of science and technology brings convenience of daily living of people. For the protection of the feet, a person often wears different types of shoes for different occasions in order to cope with the needs for such occasions and also to maintain the safety of the feet and provides the feet with comfortableness. For example, people often wear athletic shoes in taking exercises.

As shown in FIG. 1, a conventional athletic shoe 1 generally comprises a sole section 11 and an upper section 12. The upper section 12 is attached, by means of adhesives or sewing, to the sole section 11. The sole section 11 is generally provided thereon with an insole 13, which is relatively soft.

The sole section 11 is generally integrally formed through injection molding so that the sole section 11 has a top surface forming a planar receiving zone 111. The insole 13 is directly arranged in the planar receiving zone 111 on the top surface of the sole section 11. The insole 13 has a top surface that is also planar.

As shown in FIG. 2, in the use of the athletic shoe 1, a foot 2 of a wearer is put through a wearing opening 121 of the upper section 12 into the athletic shoe 1. The foot 2 is set in contact with the insole 13 with the heel 21 and the foot sole 22. More specifically, the body weight of the wearer is transmitted through the heel 21 and the foot sole 22 of the foot 2 to the insole 13 so as to be supported by the sole section 11. In other words, the arch 23 of the foot 2 is generally in a condition of being not supported.

Since the top surfaces of the sole section 11 and the insole 13 are both planar, when a wearer is taking an exercise, the heel 21 and the anterior foot sole 22 of the foot 2 of the wearer may skid frontwards in the athletic shoe 1 in a not-stopped manner. Such a condition readily causes damages to the foot 2. Further, the conventional athletic shoe 1 provides no support to the arch 23 of the foot 2 so that excessive twist and deformation of the arch 23 of the foot 2 may result during exercise and thus extreme discomfort of the foot 2, or in a worse condition, damage of the arch 23, may be caused.

Thus, it is a challenge of the shoe manufacturing industry to overcome the drawbacks of the conventional athletic shoe 1.

SUMMARY OF THE INVENTION

The primary object of the present invention is to provide a structure of an athletic shoe, which overcomes the problem that the conventional athletic shoe cannot prevent rushes of the foot of a user in the athletic shoe and cannot provide a support to the arch of the foot and thus readily causes discomfort and hurt of the foot.

To achieve the object, the technical solution adopted in the present invention is that a structure of an athletic shoe is provided, wherein the athletic shoe comprises at least a sole section and an upper section. The upper section is attached to the sole section. The upper section comprises at least a wearing opening. The sole section comprises a bottom portion, a support portion, and a receiving portion. The support portion is arranged between the receiving portion and the bottom portion and the support portion extends from a shoe heel portion of the sole section toward a shoe sole portion of the sole section. The receiving portion comprises a first trough, a second trough, and a third trough formed therein. A first soft pad that corresponds in shape to the first trough is set in the first trough. A second soft pad that corresponds in shape to the second trough is set in the second trough. A third soft pad that corresponds in shape to the third trough is set in the third trough. As such, a plurality of rush stop sites is provided in the sole section.

With the above-described technical solution, the present invention achieves the following efficacy. By arranging a first trough, a second trough, and a third trough in the receiving portion of the sole section and setting a first soft pad that corresponds in shape to the first trough in the first trough, setting a second soft pad that corresponds in shape to the second trough in the second trough, and setting a third soft pad that corresponds in shape to the third trough in the third trough, the sole section is provided with a plurality of rush stop sites thereon for alleviating front rushes of a foot in the athletic shoe so as to improve safety and comfortableness of the foot wearing the athletic shoe.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
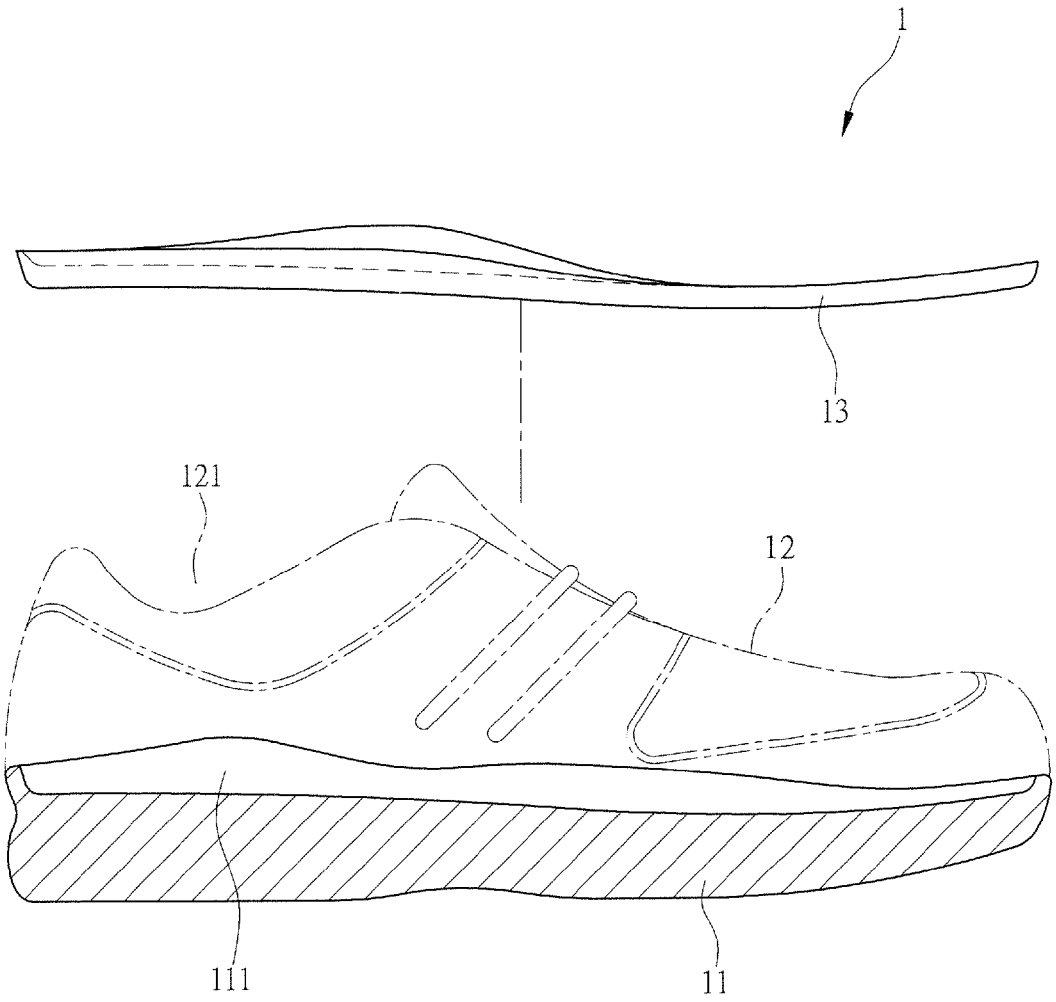
PRIOR ART FIG.1
FIG. 1 is a perspective view showing a conventional athletic shoe.
Figure 2:
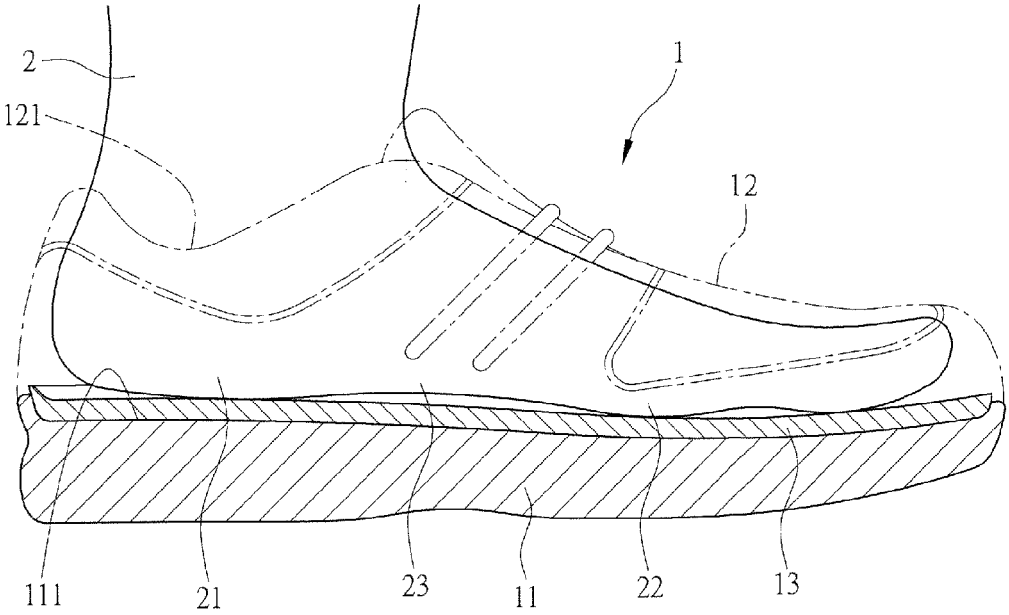
PRIOR ART FIG.2
FIG. 2 is a schematic view showing the use of the conventional athletic shoe.
Figure 3:
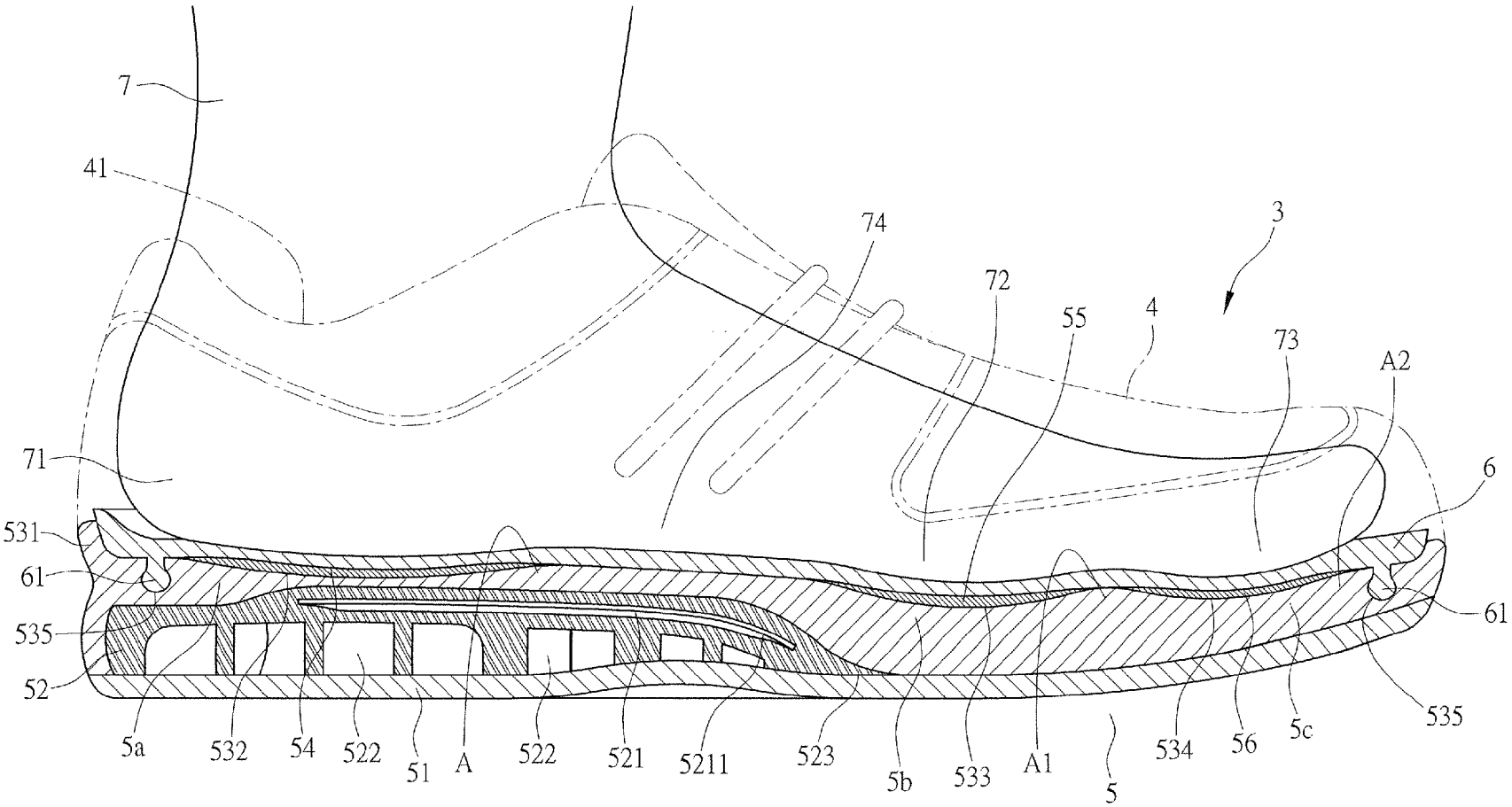
FIG. 3 is a schematic view showing an athletic shoe according to the present invention.

Referring first to FIG. 3, the present invention provides a structure of an athletic shoe. The athletic shoe 3 comprises at least an upper section 4 and a sole section 5.

As shown in FIG. 3, the upper section 4 is attached to the sole section 5 by means of adhesive or sewing. The upper section 4 has at least a wearing opening 41.

Figure 4:
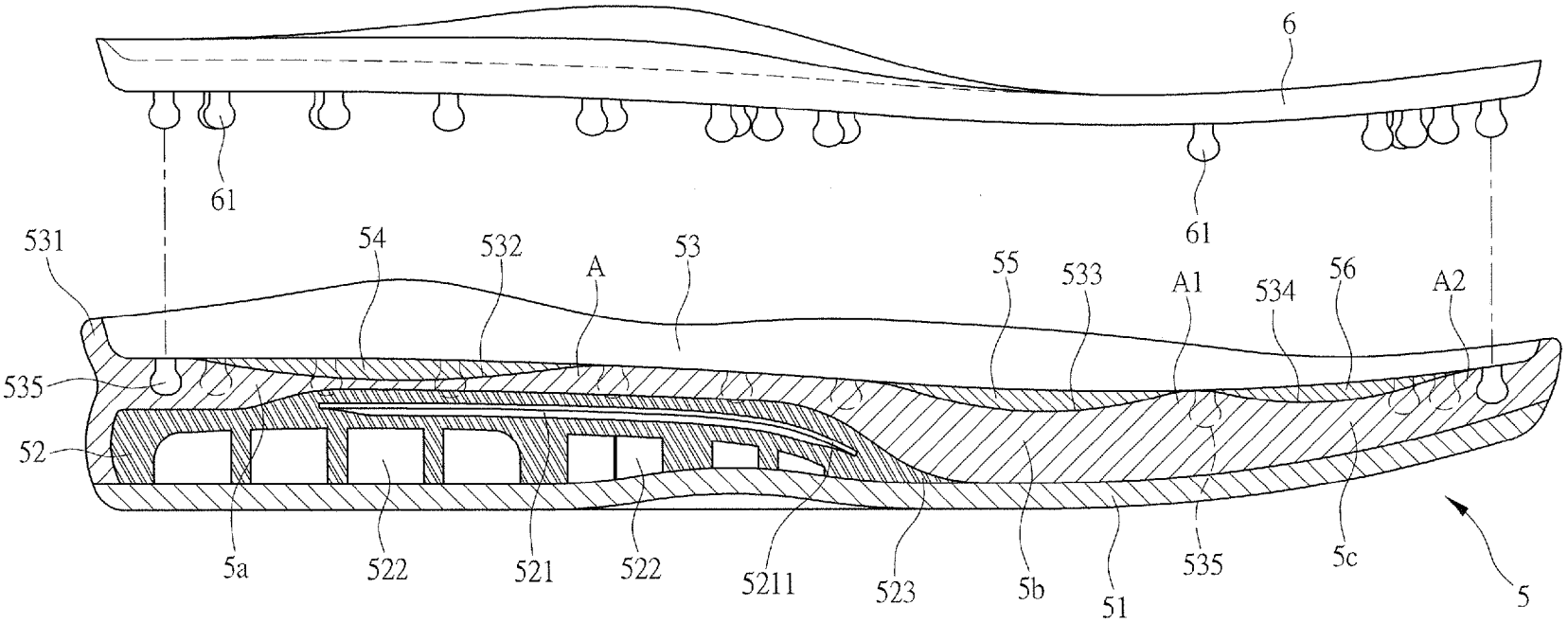
FIG. 4 is an exploded view showing a sole section of the athletic shoe of the present invention.
Figure 5:
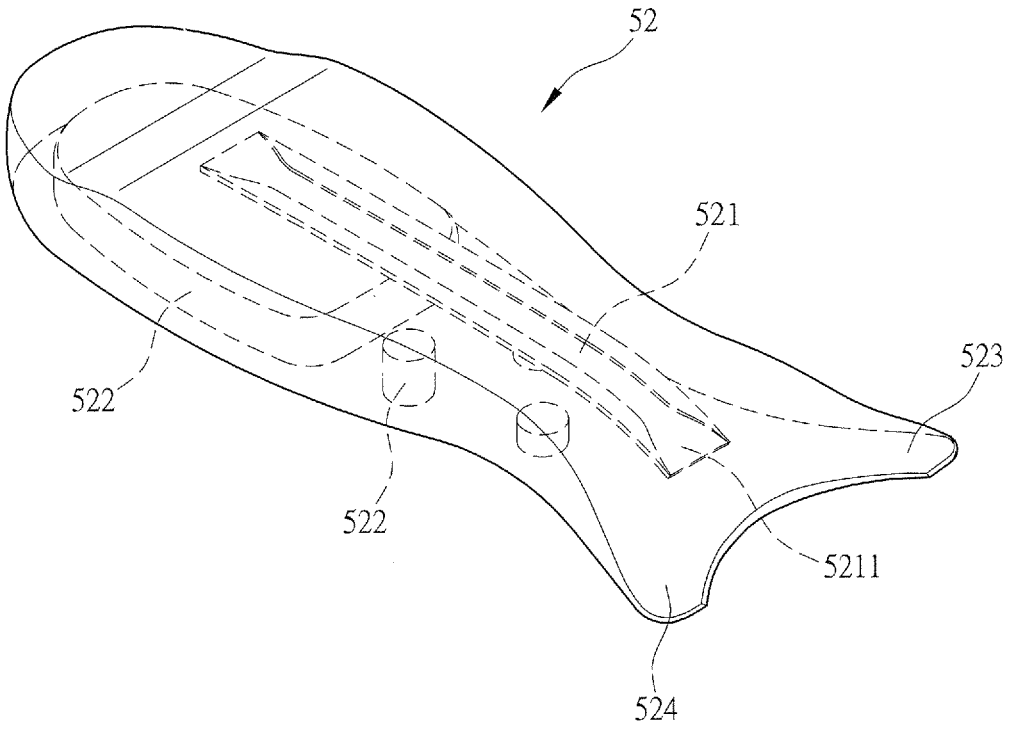
FIG. 5 is a perspective view showing a support portion of the sole section of the shoe of the present invention.

As shown in FIGS. 3, 4, and 5, the sole section 5 comprises a bottom portion 51, a support portion 52, and a receiving portion 53. As shown in FIG. 5, the support portion 52 comprises a support member 521 made of a metal or a composite material mounted therein. The support member 521 is formed inside the support portion 52 by means of overmolding in order to provide the support portion 52 with predetermined stiffness. The support portion 52 comprises hollowed portions 522 for weight reduction. The support portion 52 has an anterior end having two projecting side portions and a central concave portion, whereby the anterior end of the support portion 52 forms a first projecting section 523 and a second projecting section 524. The anterior end of the support portion 52 is configured to get thickening from the center toward the first projecting section 523 and the second projecting section 524 so that the first projecting section 523 and the second projecting section 524 and an anterior end section 5211 of the support member 521 collectively form a triangular kinetic support.

Figure 6:
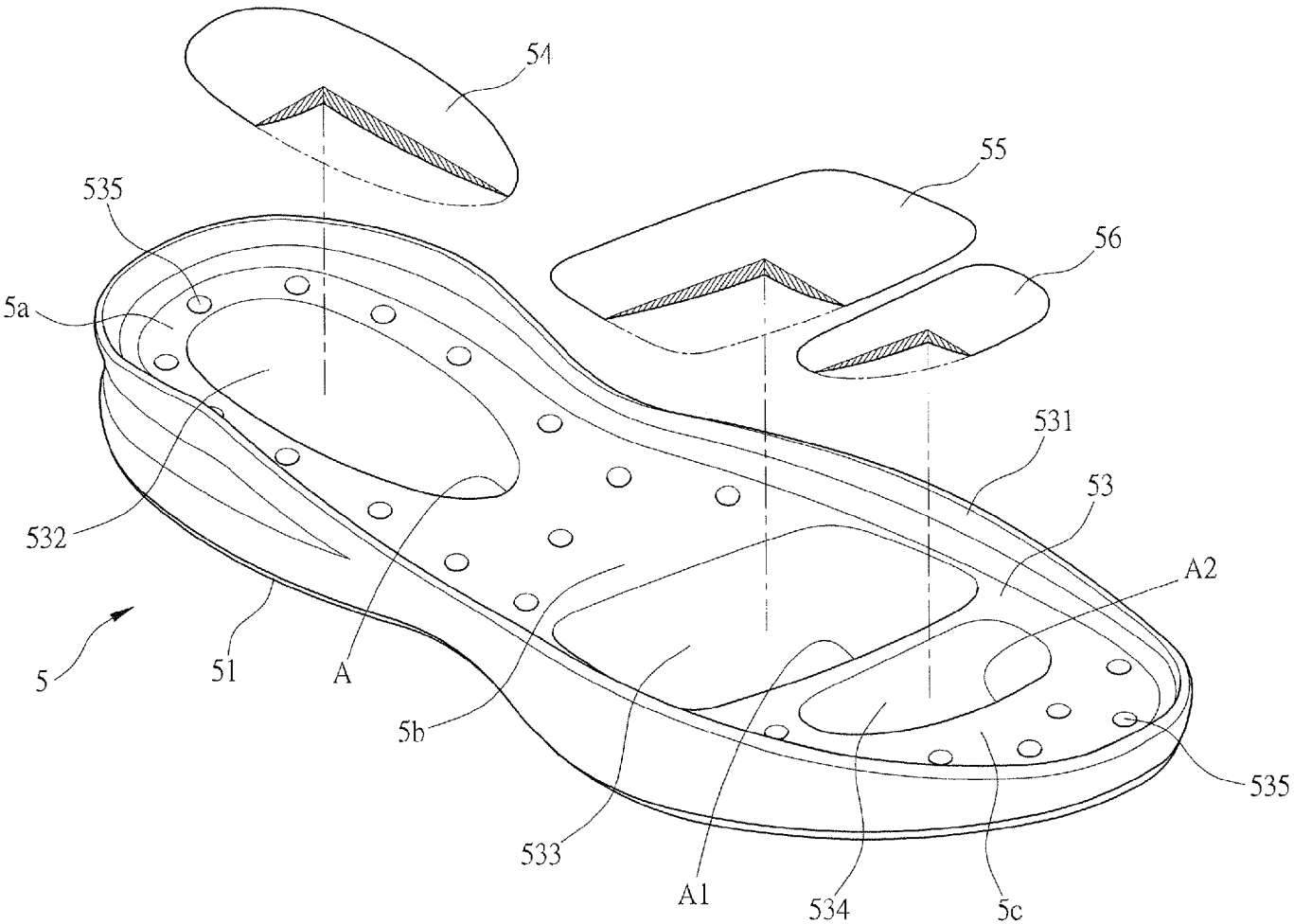
FIG. 6 is a schematic view showing the assembly of the sole section and soft pads of the shoe of the present invention.

Referring next to FIG. 6, the sole section 5 is shaped in such a way that a circumference of a top of the receiving portion 53 comprises a circumferentially extending raised rim 531. The top of the receiving portion 53 comprises a first trough 532 formed in a shoe heal portion 5*a* of the sole section 5. The first trough 532 is arranged to form in the shoe heel portion 5*a* of the sole section 5 by extending in an axial direction of the sole section 5. The first trough 532 is a concave trough having a central part that is relatively deep and a circumferential part that is relatively shallow. The top of the receiving portion 53 comprises a second trough 533 formed in a shoe sole portion 5*b* of the sole section 5. The second trough 533 is arranged to form in the shoe sole portion 5*b* of the receiving portion 53 by extending in a transverse direction of the sole section 5. The second trough 533 is a concave recess having a central part that is relatively deep and a circumferential part that is relatively shallow. The top of the receiving portion 53 comprises a third trough 534 formed in a shoe toe portion 5*c* of the sole section 5. The third trough 534 is arranged to form in the shoe toe portion 5*c* of the receiving portion 53 by extending in the transverse direction of the sole section 5. The third trough 534 is a concave recess having a central part that is relatively deep and a circumferential part that is relatively shallow. The receiving portion 53 further comprises a plurality of insertion holes 535. The insertion holes 535 are distributed in a circumferential portion of the first trough 532, the second trough 533, and the third trough 534.

Referring to FIG. 6, the first trough 532 receives therein a first soft pad 54 that is formed to match the shape of the first trough 532. The second trough 533 receives therein a second soft pad 55 that is formed to match the shape of the second trough 533. The third trough 534 receives therein a third soft pad 56 that is formed to match the shape of the third trough 534. The first soft pad 54 completely fills the first trough 532. The second soft pad 55 completely fills the second trough 533. The third soft pad 56 completely fills the third trough 534. As such, the receiving portion 54 of the sole section 5 exhibits a substantially smooth surface.

Referring to FIGS. 3, 4, and 6, the receiving portion 53 of the sole section 5 receives an insole 6 positioned therein. The insole 6 is made of a flexible material. The insole 6 has a bottom surface on which insertion pins 61 each having an expanded rounded end are formed. The insertion pins 61 are set to correspond to the insertion holes 535 of the receiving portion 53 of the sole section 5. As such, the insertion pins 61 of the insole 6 are insertable into the insertion holes 535 of the receiving portion 53 of the sole section 5 so as to have the insole 6 securely positioned on the receiving portion 53 of the sole section 5.

Referring to FIG. 6, to put the athletic shoe 3 of the present invention into practice, as shown in FIGS. 3 and 4, after a foot 7 of a wearer is put through the wearing opening 41 of the upper section 4 into the athletic shoe 3, the heel 71 of the foot 7 is supported on the shoe heel portion 5*a* of the sole section 5. In other words, the heel 71 of the foot 7 is positioned on the first trough 532 and the first soft pad 54. The anterior sole 72 of the foot 7 is supported on the shoe sole portion 5*b* of the sole section 5. In other words, the foot sole 72 of the foot 7 is positioned on the second trough 533 and the second soft pad 55. The toes 73 of the foot 7 are supported on the shoe toe portion 5*c* of the out section 5. In other words, the toes 73 of the foot 7 are positioned on the third trough 534 and the third soft pad 56. Further, the support portion 52 of the sole section 5 is located under the arch 74 of the foot 7. As such, through the weight of the wearer, the first soft pad 54, the second soft pad 55, and the third soft pad 56 are compressed and thus sink down so as to form at least three rush stop sites in the sole section 5 of the athletic shoe 3, namely a first rush stop site A formed in an anterior end of the first trough 532 (toward the second trough 533), a second rush stop site A1 formed in an anterior end of the second trough 533 (toward the third trough 534), and a third rush stop site A2 formed in an anterior end of the third trough 534 (toward the anterior end of the sole section 5). More specifically, the first rush stop site A is located in front of the heel 71 of the foot 7; the second rush stop site A1 is located in front of the foot sole 72 of the foot 7; and the third rush stop site A2 is located in front of the toes 73 of the foot 7, whereby the first rush stop site A, the second rush stop site A1, and the third rush stop site A2 may help alleviate frontward rushes of the foot 7 in the athletic shoe 3 to thus improve the safety and conformableness of the foot 7 in the athletic shoe 3.

As shown in FIG. 3, the arch 74 of the foot 7 is supported from the underside thereof by the support portion 52 of the sole section 5 so as to prevent the athletic shoe 3 from excessive swinging and twisting between the shoe heel portion 5*a* and the shoe sole portion 5*b* of the sole section 5 and also to provide a support to the arch 74 of the foot 7 by the support portion 52. As such, the overall conformableness and safety for protection against damage for the foot 7 wearing the athletic shoe 3 can be further improved.

An efficacy of the present invention is that by arranging the first trough 532, the second trough 533, and the third trough 534 in the receiving portion 53 of the sole section 5 and setting the first soft pad 54 that corresponds in shape to the first trough 532 in the first trough 532, setting the second soft pad 55 that corresponds in shape to the second trough 533 in the second trough 533, and setting the third soft pad 56 that corresponds in shape to the third trough 534 in the third trough 534, the sole section 5 is provided with a plurality of rush stop sites thereon for alleviating front rushes of a foot 7 in the athletic shoe 3 so as to improve safety and comfortableness of the foot 7 wearing the athletic shoe 3.

Another efficacy of the present invention is that the support portion 52 is provided between the receiving portion 53 and the bottom section 51 of the sole section 5 and the support portion 52 extends from the shoe heel portion 5*a* of the sole section 5 toward the shoe sole portion 5*b* of the sole section 5, so that excessive twisting of the sole section 5 of the athletic shoe 3 between the shoe heel portion 5*a* and the shoe sole portion 5*b* is prevented and the arch 74 of the foot 7 is supported by the support portion 52 to thereby improve the overall conformableness and safety for protection against damage for the foot 7 wearing the athletic shoe 3 and thus enhancing the utilization of the athletic shoe 3.

A further efficacy of the present invention is that the anterior end of the support portion 52 exhibits a configuration having two projecting opposite sides and a concave central portion so as to form a first projecting section 523 and a second projecting section 524 at the anterior end of the support portion 52 with the anterior end portion of the support portion 52 being thickened from the central portion towards the first projecting section 523 and the second projecting section 524 so that the first projecting section 523 and the second projecting section 524 and the anterior end section 5211 of the support member 521 collectively form a triangular kinematic support by which the medial longitudinal arch, the lateral longitudinal arch, and the anterior transverse arch of the foot 7 are supported, thereby ensuring stability of standing and walking of a foot 7 wearing the athletic shoe 3 and also ensuring overall comfortableness and safety for protection against damage for the foot 7 wearing the athletic shoe 3 and thus improving the utilization performance of the athletic shoe 3.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of an athletic shoe comprising at least an upper section and a sole section;

the upper section being attached to the sole section, the upper section comprising at least a wearing opening; and the sole section comprising a bottom portion, a support portion, and a receiving portion, the support portion being arranged between the bottom portion and the receiving portion, the support portion extending from a shoe heel portion of the sole section toward a shoe sole portion of the sole section, the receiving portion comprising a first trough, a second trough, and a third trough formed therein, the first trough receiving therein a first soft pad that corresponds in shape to the first trough, the second trough receiving therein a second soft pad that corresponds in shape to the second trough, the third trough receiving therein a third soft pad that corresponds in shape to the third trough, whereby the sole section is provided with a plurality of rush stop sites;

wherein the first trough is formed in a top of the receiving portion and located at a shoe heel portion of the sole section, the first trough being formed in the receiving portion of the sole section in such a way as to extend in an axial direction of the sole section, the first trough being a concave trough having a central part that is relatively deep and a circumferential part that is relatively shallow;

wherein the second trough is formed in a top of the receiving portion and located at a shoe sole portion of the sole section, the second trough being formed in the receiving portion of the sole section in such a way as to extend in a transverse direction of the sole section, the second trough being a concave trough having a central part that is relatively deep and a circumferential part that is relatively shallow;

wherein the third trough is formed in a top of the receiving portion and located at a shoe toe portion of the sole section, the third trough being formed in the receiving portion of the sole section in such a way as to extend in a transverse direction of the sole section, the third trough being a concave trough having a central part that is relatively deep and a circumferential part that is relatively shallow; and wherein the support portion has an anterior end having a configuration comprising projecting opposite sides and a concave central portion so that the anterior end of the support portion forms a first projecting section and a second projecting section, the anterior end of the support portion being thickened from the central portion towards the first projecting section and the second projecting section, whereby the first projecting section and the second projecting section and an anterior end section of the support member collectively form a triangular kinematic support by which an arch of a foot wearing the shoe is supported.

2. The structure of the athletic shoe according to claim 1, wherein the support portion comprises a support member made of a metal or a composite material mounted therein.

3. The structure of the athletic shoe according to claim 1, wherein the receiving portion comprises a plurality of insertion holes formed therein, the insertion holes being distributed in a circumferential portion of the first trough, the second trough, and the third trough, the receiving portion receiving an insole positioned therein, the insole having a bottom surface from which insertion pins project in such a way that the insertion pins respectively correspond to the insertion holes of the receiving portion of the sole section, whereby the insertion pins of the insole are insertable into the insertion holes of the receiving portion.

4. The structure of the athletic shoe according to claim 3, wherein the insertion pins each have an expanded rounded end.

5. The structure of the athletic shoe according to claim 1, wherein the sole section comprises a first rush stop site, a second rush stop site, and a third rush stop site, the first rush stop site being formed in an anterior end of the first trough, the second rush stop site being formed in an anterior end of the second trough, the third rush stop site being formed in an anterior end of the third trough.

6. The structure of the athletic shoe according to claim 5, wherein the first rush stop site is configured to be located in front of the heel of a foot wearing the shoe, the second rush stop site is configured to be located in front of a foot sole of the foot, and the third rush stop site is configured to be located in front of toes of the foot.

* * * * *